US007255349B1

(12) United States Patent
Hynes

(10) Patent No.: US 7,255,349 B1
(45) Date of Patent: Aug. 14, 2007

(54) BINGO GAME PATTERN INDICATOR AND GAME DISPLAY

(76) Inventor: James Hynes, 1939 W. Copans Rd., Pompano Beach, FL (US) 33064

( * ) Notice: Subject to any disclaimer, the term of this patent is extended or adjusted under 35 U.S.C. 154(b) by 0 days.

(21) Appl. No.: 11/476,541

(22) Filed: Jun. 28, 2006

Related U.S. Application Data

(60) Provisional application No. 60/695,744, filed on Jun. 30, 2005.

(51) Int. Cl.
*A63F 3/06* (2006.01)

(52) U.S. Cl. ..... 273/269; 273/239

(58) Field of Classification Search ..... 273/239, 273/240, 269, 270; 463/18, 19
See application file for complete search history.

(56) References Cited

U.S. PATENT DOCUMENTS 2,382,005 A * 8/1945 Durkin ..... 116/223
2,610,855 A * 9/1952 Spiller ..... 273/269
5,178,395 A * 1/1993 Lovell ..... 463/22
5,458,338 A * 10/1995 Beardsley ..... 273/269
5,478,084 A * 12/1995 Itkis ..... 273/239

OTHER PUBLICATIONS http://www.alliedbingo.com/home/ab2/page_693/magniboard.html, Allied Bingo Supplies, Bonanza Magnetic Game Displays, Magniboard, product website, Jan. 2006.*
http://us-bingo.com/cart/cart.html?tp=more_info&sku2=BKSB, US Bingo , Bingo Safety, product website, Apr. 2004.*

* cited by examiner

*Primary Examiner*—William M. Pierce
(74) *Attorney, Agent, or Firm*—Gold & Rizvi, P.A.; H. John Rizvi; Glenn E. Gold

(57) ABSTRACT

A bingo game pattern indicator and game display preferably includes a display surface and a plurality of magnetic pieces. The display surface is fabricated from a magnetic material or magnetic material is applied to the display surface. A pattern indicator is applied to one end of the display surface. The pattern indicator includes a plurality of spaces. A game display is applied to the other end of the display surface. The game display includes several rows of sequential numbers. A number at the beginning of each new row continues sequentially from a number ending the previous row. Magnetic pattern pieces are placed over the spaces in the pattern indicator to form some pattern for a game of bingo. A magnetic numeric piece is placed over each number that has been called during a game of bingo. The display surface is preferably attached to a wall with at least two fasteners.

19 Claims, 2 Drawing Sheets

BINGO GAME PATTERN INDICATOR AND GAME DISPLAY

CROSS-REFERENCE TO RELATED APPLICATION

This application claims the benefit of co-pending U.S. Provisional Patent Application Ser. No. 60/695,744, filed on Jun. 30, 2005, which is incorporated herein in its entirety.

BACKGROUND OF THE INVENTION

1. Field of the Invention

The present invention relates generally to the play of bingo and more particularly, to a bingo game pattern indicator and game display, which is less expensive to manufacture than that of the prior art.

2. Description of the Prior Art

An automated bingo game unit includes a pattern indicator represented by a plurality of rows and columns defining a plurality of spaces on one end, and a game display with several rows of sequential numbers on the other end thereof. The automated bingo game unit is attached to a wall for all players to see. The spaces in the pattern indicator and the sequential numbers in the game display include individual light emitting devices for illumination of each space or number. The pattern indicator represents a bingo card. A pattern is illustrated by illuminating some of the spaces.

When a particular number is called during the bingo game, the particular number is illuminated on the game display. Random numbers are called, until someone playing the game has a bingo card with the called numbers that replicate the pattern on the pattern indicator. The automated bingo game unit costs at least five thousand dollars. However, the five thousand dollars is too much for most small bingo operations to afford.

Accordingly, there is an established need for a bingo game pattern indicator and game display, which includes a non-illuminated pattern indicator, a non-illuminated game display, a plurality of magnetic pieces and is less expensive to manufacture than that of the prior art.

SUMMARY OF THE INVENTION

The invention is directed to a bingo game pattern indicator and game display, which includes a graphical representation of a pattern indicator and a game display that is applied to a display surface with any suitable process.

In one general aspect of the present invention, the bingo game pattern indicator and game display include a pattern indicator with a plurality of rows and columns defining a plurality of spaces.

In another aspect of the present invention, the bingo game pattern indicator and game display include a game display with several rows of sequential numbers.

In a further aspect of the present invention, the bingo game pattern indicator and game display include a plurality of magnetic pattern pieces that are applied to specific spaces in the pattern indicator to form a pattern.

In yet a further aspect of the present invention, the bingo game pattern indicator and game display include a plurality of magnetic numeric pieces that are applied over a number that is called during a game of bingo.

In yet a further aspect of the present invention, the bingo game pattern indicator and game display include mounting thereof to a wall for all bingo game players to see.

These and other aspects, features, and advantages of the present invention will become more readily apparent from the attached drawing and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Figure 1:
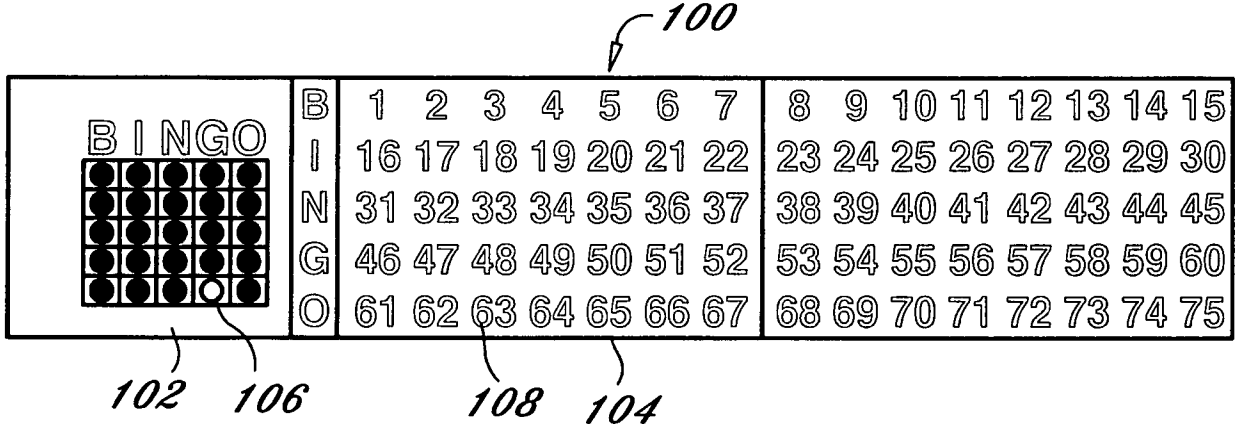
FIG. 1 (PRIOR ART)
FIG. 1 is a front view of a prior art automated bingo game unit.

Shown throughout the figures, the present invention is generally directed to a bingo game pattern indicator and game display 1. Referring briefly to FIG. 1, an automated bingo game unit 100 includes a pattern indicator 102 and a game display 104. The pattern indicator 102 includes a plurality of rows and columns defining a plurality of spaces 106. The game display 104 includes several rows of sequential numbers 108. A light emitting device (not shown) is located behind each space 106 and each number 108. The light emitting devices behind a set of spaces 106 are powered to display a bingo pattern. The light emitting device behind a particular number is powered, when that number is called during a game.

Figure 2:
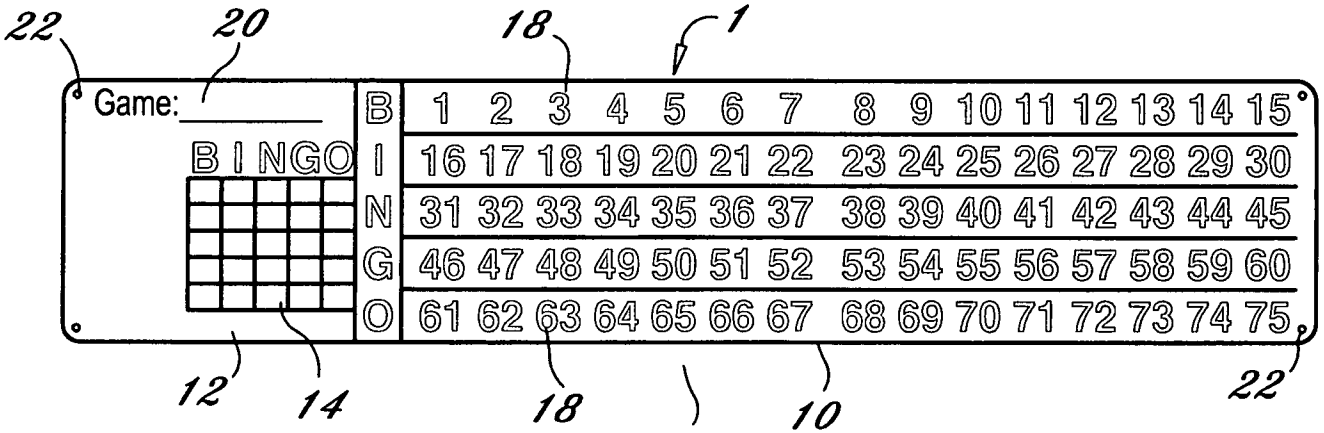
FIG. 2 is a front view of a bingo game pattern indicator and game display.

Referring briefly to FIG. 2, the bingo game pattern indicator and game display 1 preferably includes a display surface 10 and a plurality of magnetic pieces. The display surface 10 is preferably a flat plate, but could be raised or recessed. The display surface 10 could be fabricated out of magnetic material, such as steel or a magnetic material may be applied to a nonmagnetic display surface. A plurality of rows and columns are applied on one end of the display surface 10 with any suitable method to create a pattern indicator 12. The plurality of rows and columns creates a plurality of spaces 14. A game display 16 is applied on the other end of the display surface 10 with any suitable method. The game display 16 includes several rows of sequential numbers 18. A number at the beginning of each new row continues sequentially from a number ending the previous row. A game pattern logo 20 is preferably applied above the pattern indicator 12. The type of pattern may be indicated, adjacent the game indication logo with a magnetic number or writing with an erasable marking pen. An attachment hole 22 is preferably formed through each corner of the display surface 10.

Figure 3:
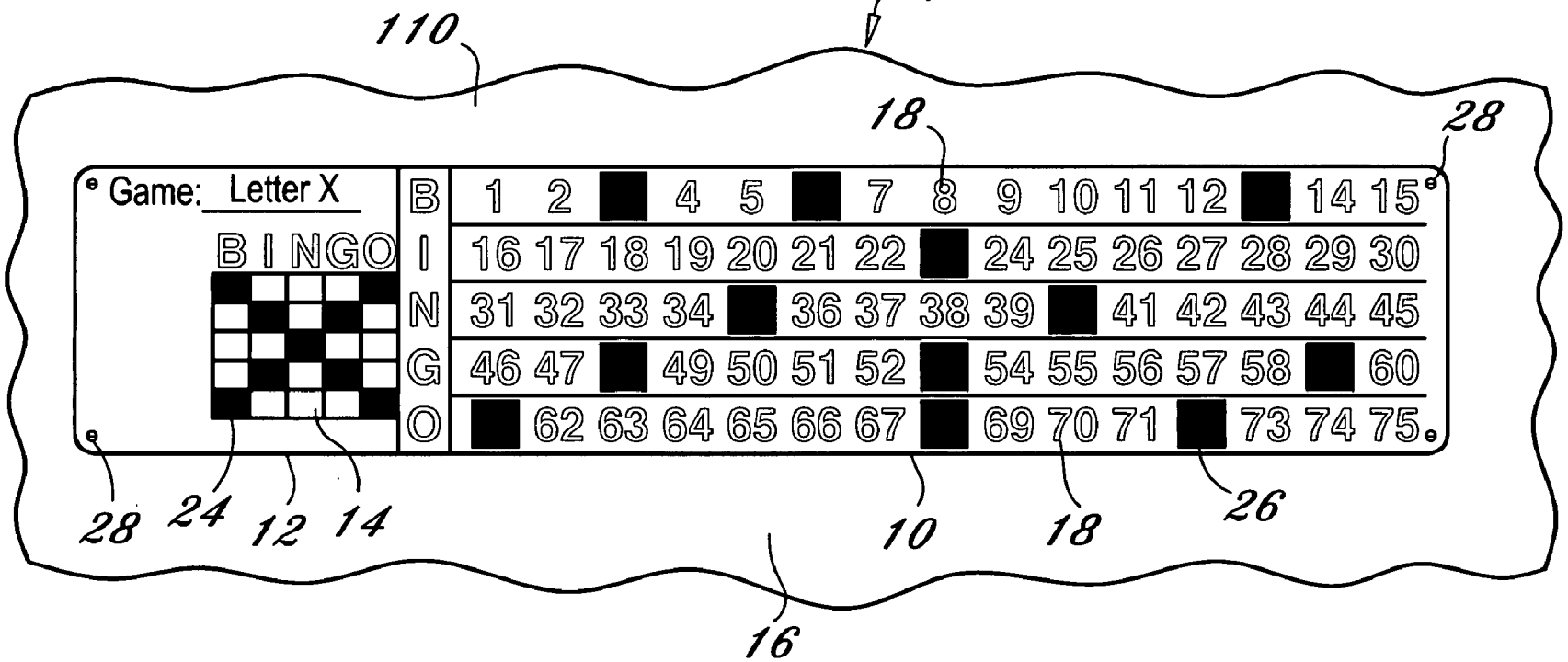
FIG. 3 is a front view of a bingo game pattern indicator and game display with a plurality of magnetic pattern pieces applied to selective spaces and a plurality of magnetic numeric pieces covering called numbers.

Referring briefly to FIG. 3, a plurality of magnetic pattern pieces 24 are placed over spaces 14 in the pattern indicator 12 to form a crossing pattern for a game of bingo. A magnetic numeric piece 26 is placed over each number 18 that has been called during a game of bingo. Each magnetic pattern piece 24 and each magnetic numeric piece 26 is preferably a vinyl sheet magnet, similar to that displaying advertising, which are attached to a refrigerator door. The magnetic pattern pieces 24 and the magnetic numeric pieces 26 are magnetically attracted to the magnetic material of the display surface 10. The magnetic pieces are shown as having a square shape, but could have any other appropriate shape. The display surface 10 is preferably attached to a wall 110 with at least two fasteners 28. Each fastener 28 is inserted through a single attachment hole 22.

The operator of the game chooses the type of pattern and displays the pattern with the magnetic pattern pieces 24 on the pattern indicator 12, before the bingo game starts. The operator of the game calls out a number and then places the magnetic numeric piece 26 over the called number 18. The first person to have the pattern shown on the pattern indicator 12 with the called numbers wins the bingo game.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A bingo game pattern indicator and game display, comprising:

a display surface having a pattern indicator and a game display, said pattern indicator including a plurality of rows and columns defining a plurality of spaces, said game display having a plurality of rows with a plurality of sequential numbers;

a plurality of magnetic pattern pieces, each one of said plurality of magnetic pattern pieces being sized to cover one of said plurality of spaces; and a plurality of magnetic numeric pieces, each one of said plurality of magnetic pattern pieces being sized to cover one of said plurality of sequential numbers.

2. The bingo game pattern indicator and game display of claim 1, wherein:

said display surface being fabricated from a material that attracts said plurality of magnetic pattern pieces and said plurality of magnetic numeric pieces.

3. The bingo game pattern indicator and game display of claim 1, wherein:

applying a material to said display surface that attracts said plurality of magnetic pattern pieces and said plurality of magnetic numeric pieces.

4. The bingo game pattern indicator and game display of claim 1, wherein:

a number at a beginning of each successive row of said plurality of sequential numbers continuing sequentially from a number ending in a previous row of said plurality of sequential numbers.

5. The bingo game pattern indicator and game display of claim 1, wherein:

forming at least two holes through said game display, attaching said game display to a wall with at least two fasteners.

6. The bingo game pattern indicator and game display of claim 1, wherein:

a game pattern logo is applied to the game display, the type of pattern being affixed adjacent the game pattern logo.

7. The bingo game pattern indicator and game display of claim 1, wherein:

said pattern indicator being applied to one end of said display surface and said game display being applied to the other end of said display surface.

8. A bingo game pattern indicator and game display, comprising:

a display surface having a pattern indicator and a game display, said pattern indicator including a plurality of rows and columns defining a plurality of spaces, said game display having a plurality of rows with a plurality of sequential numbers;

a plurality of magnetic pattern pieces, each one of said plurality of magnetic pattern pieces being sized to cover one of said plurality of spaces, applying said magnetic pattern pieces over said plurality of spaces in said pattern indicator to form some pattern for playing a game of bingo; and a plurality of magnetic numeric pieces, each one of said plurality of magnetic pattern pieces being sized to cover one of said plurality of sequential numbers, covering one of said plurality of sequential numbers called during a game bingo with one of said plurality of magnetic numeric pieces.

9. The bingo game pattern indicator and game display of claim 8, wherein:

said display surface being fabricated from a material that attracts said plurality of magnetic pattern pieces and said plurality of magnetic numeric pieces.

10. The bingo game pattern indicator and game display of claim 8, wherein:

applying a material to said display surface that attracts said plurality of magnetic pattern pieces and said plurality of magnetic numeric pieces.

11. The bingo game pattern indicator and game display of claim 8, wherein:

a number at a beginning of each successive row of said plurality of sequential numbers continuing sequentially from a number ending in a previous row of said plurality of sequential numbers.

12. The bingo game pattern indicator and game display of claim 8, wherein:

forming at least two holes through said game display, attaching said game display to a wall with at least two fasteners.

13. The bingo game pattern indicator and game display of claim 8, wherein:

a game pattern logo is applied to the game display, the type of pattern being affixed adjacent the game pattern logo.

14. A bingo game pattern indicator and game display, comprising:

a display surface having a pattern indicator and a game display, said pattern indicator including a plurality of rows and columns defining a plurality of spaces, said game display having a plurality of rows with a plurality of sequential numbers;

a plurality of magnetic pattern pieces, each one of said plurality of magnetic pattern pieces being sized to cover one of said plurality of spaces, said plurality of pattern pieces being magnetically attracted to said display surface; and a plurality of magnetic numeric pieces, each one of said plurality of magnetic pattern pieces being sized to cover one of said plurality of sequential numbers, said plurality of pattern pieces being magnetically attracted to said display surface.

15. The bingo game pattern indicator and game display of claim 14, wherein:

said display surface being fabricated from a material that attracts said plurality of magnetic pattern pieces and said plurality of magnetic numeric pieces.

16. The bingo game pattern indicator and game display of claim 14, wherein:

applying a material to said display surface that attracts said plurality of magnetic pattern pieces and said plurality of magnetic numeric pieces.

17. The bingo game pattern indicator and game display of claim 14, wherein:

a number at a beginning of each successive row of said plurality of sequential numbers continuing sequentially from a number ending in a previous row of said plurality of sequential numbers.

18. The bingo game pattern indicator and game display of claim 14, wherein:

forming at least two holes through said game display, attaching said game display to a wall with at least two fasteners.

19. The bingo game pattern indicator and game display of claim 14, wherein:

a game pattern logo is applied to the game display, the type of pattern being affixed adjacent the game pattern logo.

* * * * *